US006449791B1

(12) United States Patent
Vodicka

(10) Patent No.: US 6,449,791 B1
(45) Date of Patent: Sep. 17, 2002

(54) PREFABRICATED PIER SYSTEM

(76) Inventor: Dennis A. Vodicka, 206 8th Corso, Nebraska City, NE (US) 68410

( * ) Notice: Subject to any disclaimer, the term of this patent is extended or adjusted under 35 U.S.C. 154(b) by 0 days.

(21) Appl. No.: 09/810,163

(22) Filed: Mar. 19, 2001

(51) Int. Cl.[7] ..... E01D 19/02; E02D 5/22

(52) U.S. Cl. ..... 14/75; 405/231; 52/721.2; 52/736.2; 52/737.2

(58) Field of Search ..... 14/75, 77.3; 405/231, 405/250, 256; 52/721.1, 721.2, 724.1, 736.1, 736.2, 737.2

(56) References Cited

U.S. PATENT DOCUMENTS

| | | | | | |
|---|---|---|---|---|---|
| 1,119,969 | A | * | 12/1914 | Longevin | 249/26 |
| 2,185,860 | A | * | 1/1940 | McAlpine | 249/26 |
| 3,100,968 | A | | 8/1963 | Bourdon | |
| 3,662,559 | A | | 5/1972 | Swift | |
| 3,685,866 | A | * | 8/1972 | Patenaude | 403/189 |
| 3,750,210 | A | * | 8/1973 | Barnard et al. | 14/75 |
| 3,798,867 | A | | 3/1974 | Starling | |
| 3,894,374 | A | | 7/1975 | Faucheux | |
| 4,015,303 | A | * | 4/1977 | Eyb et al. | 14/27 |
| 4,091,594 | A | * | 5/1978 | Yamashita | 52/283 |
| 4,349,297 | A | | 9/1982 | Misener | |
| 4,409,764 | A | | 10/1983 | Wilnau | |
| 4,550,536 | A | | 11/1985 | Lamoure | |
| 4,767,241 | A | | 8/1988 | Wells | |
| 4,977,636 | A | | 12/1990 | King | |
| 5,038,541 | A | * | 8/1991 | Gibbar, Jr. | 52/295 |
| 5,210,991 | A | | 5/1993 | Hakala et al. | |
| 5,771,518 | A | | 6/1998 | Roberts | |
| 5,836,124 | A | | 11/1998 | Aspenhaug et al. | |
| 5,870,789 | A | | 2/1999 | Carranza-Aubry | |
| 5,946,867 | A | | 9/1999 | Snider, Jr. et al. | |
| 5,966,764 | A | | 10/1999 | Vodicka | |
| 5,987,680 | A | * | 11/1999 | Sakaya | 14/73 |
| 6,120,208 | A | * | 9/2000 | Hong | 14/75 |
| 6,141,936 | A | | 11/2000 | Butler, Jr. | |

* cited by examiner

*Primary Examiner*—Gary S. Hartmann
(74) *Attorney, Agent, or Firm*—Richard C. Litman

(57) ABSTRACT

A prefabricated pier system provides prefabricated foundation and cap components for assembly with a series of steel H section columns to facilitate construction of bridges, overpasses, and similar structures. Each foundation component comprises a prefabricated column base sleeve, with sleeve pairs welded to a horizontal support to form pier foundation assemblies. These prefabricated assemblies are then welded to leveling beam pairs at the construction site and anchored in a concrete footing to form the foundation for each pier assembly. Each pier cap comprises a series of prefabricated sections, each having a single depending column end pocket for accepting a pair of column members therein. The sections are assembled to form the completed pier cap box, installed atop the column members, and used as a permanent form for casting the concrete pier cap. The present system may be used with either conventional single girder span construction or with built up girders.

10 Claims, 5 Drawing Sheets

PREFABRICATED PIER SYSTEM

BACKGROUND OF THE INVENTION

1. Field of the Invention

The present invention relates generally to structures for bridges, roadway overpasses, and the like, and more specifically to a prefabricated pier system in which both the pier bases and pier caps are prefabricated at a manufacturing facility removed from the construction site, and shipped to the construction site for assembly. The pier caps then serve as permanent forms for the casting of the concrete pier cap beams for the structure.

2. Description of Related Art

Conventionally, bridge and overpass construction involves the on site construction of a series of temporary forms for casting reinforced concrete structural members, which forms are later removed once the concrete has cured. This is generally a relatively long and drawn out process, as it is necessary initially to construct forms for the pier foundations, then wait for the concrete to cure before forming further concrete structures above the foundations, with a further delay for curing before finally forming the pier caps and upper structure.

The time required for concrete to cure to full strength can take days or even weeks, depending upon the concrete mass, the mixture used, the curing process, the weather and temperature, and perhaps other factors as well. Yet, with conventional construction where a series of concrete components are formed progressively from the footings, some delay at each step of the way is required due to the time required for constructing concrete forms for each step and the curing time for each of the several concrete castings required. As a result, conventional bridge construction is a time intensive operation, even where many prefabricated components (prestressed concrete beams and slabs, steel girders, etc.) are used. The relatively large amount of time required also greatly increases the costs of such projects, due to the necessity of keeping the required labor force on the payroll through completion of the project or at least until that labor is no longer required. Obviously, some means of reducing much of the delay in such conventional construction is a desirable goal.

Accordingly, the present invention provides a solution to the above problem by providing a prefabricated pier system which eliminates most of the above steps in the construction of a bridge or the like. The present invention comprises the fabrication of a series of pier bases and pier caps at a manufacturing site remote from the bridge construction site, with the prefabricated components then being shipped to the construction site for installation.

The prefabricated pier bases are then set into a concrete footing at the construction site, with a corresponding series of steel pier members then installed and welded in the pier bases after the concrete footing has cured. The prefabricated pier caps are then installed and welded to the tops of the piers, with the caps serving as permanently installed forms for casting the transverse pier cap beams in place. The present construction thus greatly reduces the number of pours of concrete used in conventional bridge construction, and accordingly greatly reduces the time required and corresponding labor and other costs incurred in such construction.

A discussion of the related art of which the present inventor is aware, and its differences and distinctions in comparison to the present invention, is provided below.

U.S. Pat. No. 3,100,968 issued on Aug. 20, 1963 to Thomas E. Bourdon, titled "Marine Dock," describes a dock structure adapted to temporary, seasonal installation in a body of water. The pier foundations comprise a series of heavy metal bases with two metal columns extending upwardly from each base, with no direct connection between the bases. A transverse beam is installed between each set of columns of each pair of bases. However, the transverse beam is a continuous structure, with no prefabricated pier caps being disclosed for the fabrication of the transverse beam on site. The Bourdon structure teaches away from the present permanently installed bridge construction, as the Bourdon structure must be relatively light for portability.

U.S. Pat. No. 3,662,559 issued on May 16, 1972 to Wesley K. Swift, titled "Anchorage For Boat Docks," describes a floating dock structure with permanently installed piers. The pier structure comprises a pair of vertical columns linked together for stability, with concrete poured around the bases and link for security. Sleeves are attached to the dock structure to ride vertically along the pier columns, with the buoyant dock structure floating on the surface of the water as is well known in the art. Swift teaches away from the present invention with his buoyant dock structure movably secured to his vertical piers. He does not disclose any form of permanently installed pier caps immovably affixed to the vertical piers, nor the use of concrete for any of the upper structure of his pier, as is done with the present prefabricated pier structure.

U.S. Pat. No. 3,798,867 issued on Mar. 26, 1974 to Benjamin F. Starling, titled "Structural Method And Apparatus," describes a method of repairing existing, previously installed support columns and piers, rather than the fabrication of new structures as provided by the present invention. Starling provides a casing or enclosure which is installed around the existing column, with a suitable agent (epoxy or concrete) being poured into the casing to surround and reinforce the existing column. While Starling discloses such a reinforcement method in combination with an HP (H section pier) member, he does not disclose any means of installing the HP member in the first place, nor any means of providing a prefabricated pier cap for forming the pier cap beam.

U.S. Pat. No. 3,894,374 issued on Jul. 15, 1975 to Pierre Faucheaux, titled "Set Of Elements For The Construction Of Buildings," describes provision of a base plate which is imbedded in concrete to form a foundation structure. The base plate includes upright tubular members upon which vertical support posts are installed. A series of transverse beams are then installed atop the vertical posts. The posts and beams are hollow, and comprise non-recoverable forms for pouring concrete therein. However, the Faucheaux construction does not provide a series of prefabricated pier caps which are joined together to provide a pier beam form, as provided by the present prefabricated pier system.

U.S. Pat. No. 4,349,297 issued on Sep. 14, 1982 to Terrance J. Misener, titled "Boat Dock," describes a dock structure having a series of separate pier foundations, with each foundation having a single tubular pier extending vertically upwardly therefrom. The piers are joined longitudinally by tubular stringers essentially defining the two edges of the dock, with a series of transverse plastic planks installed over the stringers. This construction does not require the transverse pier beams of the present bridge construction, and accordingly does not provide any prefabricated pier caps, as provided in the present pier construction. Moreover, the pier foundations of the Misener dock construction are not directly connected to one another, whereas the piers of each pier assembly of the present construction are all directly connected at their upper and lower ends, respectively by the corresponding pier foundation and pier cap beam.

U.S. Pat. No. 4,409,764 issued on Oct. 18, 1983 to John A. Wilnau, titled "System And Method For Reinforced Concrete Construction," describes a system having a series of prefabricated hollow forms which are bolted in place and to one another, with a single pouring of concrete being made to fill all of the internally interconnected forms. Wilnau does not provide a single pier foundation structure which is set into a single corresponding footing dug therefor, as in the present pier system. Rather, each column of the Wilnau construction has its own, separate foundation. Moreover, Wilnau utilizes a pair of widely spaced reinforced concrete columns to support a lateral beam of reinforced concrete thereacross, unlike the series of steel HP members which support the bolted together pier cap sections, and thus the reinforced concrete pier cap beam formed therein, of the present system.

U.S. Pat. No. 4,550,536 issued on Nov. 5, 1985 to Jean F. Lamoure, titled "Industrial Building Framework Formed From Prefabricated Reenforced Concrete Elements," describes a building framework constructed of a series of precast or prestressed concrete members. Lamoure teaches away from the present pier construction, in that he states that his concrete members are all prefabricated (column 1, line 11). Thus, he has no motivation to provide pier caps or the like constructed of a series of separate shells or forms which may be joined together at the construction site for forming a concrete pier cap beam on-site, as the present invention provides.

U.S. Pat. No. 4,767,241 issued on Aug. 30, 1988 to Gordon T. Wells, titled "Method For Simultaneous Forming Of Concrete Footings And Piers," describes a pier system having a hollow foundation and tubular pier column, with the hollow interiors of the foundation and pier column communicating with one another. Concrete is poured into the assembly to provide simultaneous fill of both the foundation and the pier. The Wells system teaches away from the present system, in that the present system utilizes HP (H section pier) members rather than hollow pier supports. Moreover, Wells is silent regarding any form of pier cap structure for his pier and footing forming method, whereas one of the key aspects of the present invention is the prefabricated construction of the pier cap sections at a location removed from the construction site, and their assembly at the construction site to form the pier cap beams.

U.S. Pat. No. 4,977,636 issued on Dec. 18, 1990 to John B. King, titled "Pile Supported Bridge Assembly," describes a system using precast concrete members for the pilings or piers, the pier cap beams, and the slabs used to form the foundation for the road surface thereover. King recognizes the problem of excessive environmental damage which may occur when concrete structures are formed on site, as well as the time required for on site concrete construction methods. However, King is silent regarding the installation of any footings for the piers, and moreover teaches away from the present invention by precasting his concrete pier beams off site, rather than prefabricating pier caps and assembling them on site to serve as pier beam forms, as in the present system.

U.S. Pat. No. 5,210,991 issued on May 18, 1993 to Jaakko Hakala et al., titled "Method For Making The Foundation Slabs Of A Paper Machine Before The Installation Proper Of The Machine," describes the steps involved in the construction of a foundation for a paper making machine. Hakala et al. form the horizontal support beams in situ atop vertical pilings, somewhat in the manner used for the present pier construction. However, Hakala et al. do not provide a multiple segment, prefabricated form or mold for the beam, as is the case with the present construction system. Moreover, Hakala et al. bolt the beam to the underlying piers, rather than welding the steel form or mold to the piers, as is the case with the present construction system. Also, Hakala et al. are silent regarding any form of footing structure for their piers.

U.S. Pat. No. 5,771,518 issued on Jun. 30, 1998 to Michael L. Roberts, titled "Precast Concrete Bridge Structure And Associated Rapid Assembly Methods," describes a system wherein all major components are formed of concrete. The piers are formed of a quick setting polymer concrete, which is pumped downwardly through the aggregate material with which the outer shells of the piers have been filled. The Roberts deck support beams also appear to be formed of precast reinforced concrete, rather than being formed of rolled steel, as in the case of the deck support beams and piers of the present system. Moreover, Roberts does not disclose any form of prefabricated, multiple unit modular pier cap beam forms for assembly in situ for forming the pier cap beams, as provided by the present construction system.

U.S. Pat. No. 5,836,124 issued on Nov. 17, 1998 to Nils Aspehaug et al., titled "Foundation Tube For Use As A Foundation For Masts, Posts, Pillars, Etc.," describes a method of installing a tubular member into the underlying substrate. A footing hole is dug and the tube is inserted therein, with concrete being pumped downwardly around the outer circumference of the tube, between the tube and the ground. The tube may have perforations to allow the concrete to flow into the center of the lower end of the tube. The present invention differs considerably in using structural steel pier members which are inserted into steel sockets which are in turn welded to a steel foundation structure which is set into a concrete foundation. Aspehaug et al. are silent regarding any form of structure which resides atop and/or is supported by their pier structure.

U.S. Pat. No. 5,870,789 issued on Feb. 16, 1999 to Rene Carranza-Aubry, titled "Precast Bridges," describes another bridge structure in which all of the major components are formed of precast, reinforced concrete. The Carranza-Aubry structure includes various interlocking shapes to provide a secure structure. However, Carranza-Aubry does not disclose the use of steel foundation sockets for supporting steel HP members, as provided by the present invention, nor does he disclose the prefabrication of a plurality of modular pier beam cap forms for assembly at the construction site for use in forming the reinforced concrete pier caps on site, as provided by the present construction system.

U.S. Pat. No. 5,946,867 issued on Sep. 7, 1999 to Randle P. Snider, Jr. et al., titled "Modular Earthquake Support For Raised Floor," describes a structure formed of a series of steel beams and columns, with the columns being bolted into sockets which are mounted to plates bolted to the underlying concrete floor. While the Snider, Jr. et al. structure could be extended to form a longer structure, such as a bridge, Snider, Jr. et al. do not use any concrete in their structure, other than the conventional concrete slab used for the floor of the surrounding building structure in which their earthquake support is installed. Accordingly, Snider, Jr. et al. have no motivation to provide a series of prefabricated modular concrete forms for casting pier caps in situ, as is provided by the present invention.

U.S. Pat. No. 5,966,764 issued on Oct. 19, 1999 to Dennis A. Vodicka, titled "Roll Beam Girder System For Bridges," describes a longitudinal girder system utilizing mating sections of steel girders formed by means of a conventional rolling process. The girders are built up of two individual girders stacked vertically, with end to end mating sections having a "keystone" fit and forming a slight arch when assembled. The system allows the relatively shorter girder sections to be prefabricated at a manufacturing site remote from the bridge construction for ease of transport, and quickly assembled at the construction site. However, no disclosure is made of any prefabricated pier cap forms for assembly at the construction site, as provided by the present prefabricated pier system invention.

Finally, U.S. Pat. No. 6,141,936 issued on Nov. 7, 2000 to Robert P. Butler, Jr., titled "prefabricated Concrete Footings," describes a prefabricated concrete footing for relatively light construction, such as for use in supporting columns for decks and single story structures. The Butler, Jr. prefabricated concrete footings solve various problems with accurate mixing and preparation of excessive quantities of concrete which may occur at the building site. However, Butler, Jr. does not disclose the construction of any prefabricated modular concrete forms at a manufacturing site, for transport to the site for assembly and forming concrete structures therefrom at the building site, as provided by the present invention.

None of the above inventions and patents, either singly or in combination, is seen to describe the instant invention as claimed.

SUMMARY OF THE INVENTION

The present invention is a prefabricated pier system for facilitating and accelerating the construction of bridges, overpasses, and other related structures requiring a series of spaced apart, generally vertical columns for supporting further structure thereupon. The present prefabricated system may be used to support a conventional horizontally disposed girder assembly, or may be used to support a series of prefabricated compression girders constructed in accordance with U.S. Pat. No. 5,966,764 issued to the present inventor, discussed further above and incorporated herein by reference.

The present system comprises a series of prefabricated column or pier base socket or sleeve assemblies and a further series of modular pier cap forms, which are manufactured at a site remote from the construction site of the bridge or other structure. These prefabricated components are then transported to the construction site for the pier supported structure. The pier base sleeve assemblies are secured (preferably welded) to a pair of parallel, underlying leveling beams which are in turn set into the concrete pier foundation. A series of steel HP ("H" section pile) members is then placed in the pier base sleeves, and the pier cap forms are assembled in place atop the HP column members, and permanently secured (welded, etc.) thereto.

If conventional horizontal girders are to be used in the structure, the completed pier cap form assembly is filled with concrete (with appropriate reinforcing and girder anchor means), and the horizontal girders are attached. If the compression girders of the present inventor's issued '764 U.S. Patent are used, then any required support members (additional H or I beam lengths, etc.) are installed within the pier cap forms, the horizontal longitudinal girders of the structure are installed atop these support members, and the pier cap forms are filled with concrete and appropriate reinforcing means.

It will be seen that the concrete does not provide any addition in strength to the present steel structure, but rather provides additional weight and mass which serves to anchor the underlying pier structure more substantially. The present system thus provides three different anchoring principles for the structure: (1) The pier members are welded (or otherwise securely attached) at their ends to the underlying pier foundation sockets and to the prefabricated pockets of the pier cap sections, respectively; (2) wedge members are installed in the pier end pockets of the pier caps, to the outside of each pier member pair, to wedge the abutting upper ends of the pier members securely within each pier cap pocket; and (3) the weight and mass of the concrete fill within the pier cap form assembly provides additional compressive force on the pier caps to anchor the system together. The present invention thus results in relatively quick and straightforward construction for bridges, overpasses, and other similar structures requiring a series of piers, pier caps, and girders in their construction.

Accordingly, it is a principal object of the invention to provide a prefabricated pier system for the construction of bridges, overpasses, and the like, in which the system comprises a series of prefabricated pier foundation members and pier cap form members fabricated at a site remote from the construction site, with the pier foundation members and pier cap members being transported to the construction site for assembly.

It is another object of the invention to provide pier foundation members, each member comprising two spaced apart sockets for seating the lower ends of a corresponding pair of steel H section pier members therein, and pier cap members, each member comprising a box-like structure having a pier pocket depending therefrom for accepting the upper ends of a pair of pier members therein.

It is a further object of the invention to provide a series of pier cap members of modular construction for end to end assembly at the construction site, with the assembled pier cap form serving as the structural pier cap and further serving as a permanent form for casting concrete therein.

Still another object of the invention is to provide a prefabricated pier system which is adaptable to the support of both conventional rolled steel girders and to girders constructed in accordance the disclosure of U.S. Pat. No. 5,966,764, issued to the present inventor and incorporated herein by reference.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a prefabricated pier system, comprising prefabricated steel foundation and pier cap components. The components are manufactured at a location remote from the pier construction site, and transported to the site for assembly. The present invention greatly facilitates and speeds the construction of bridges, overpasses, and other similar pier supported structures.

Figure 1:
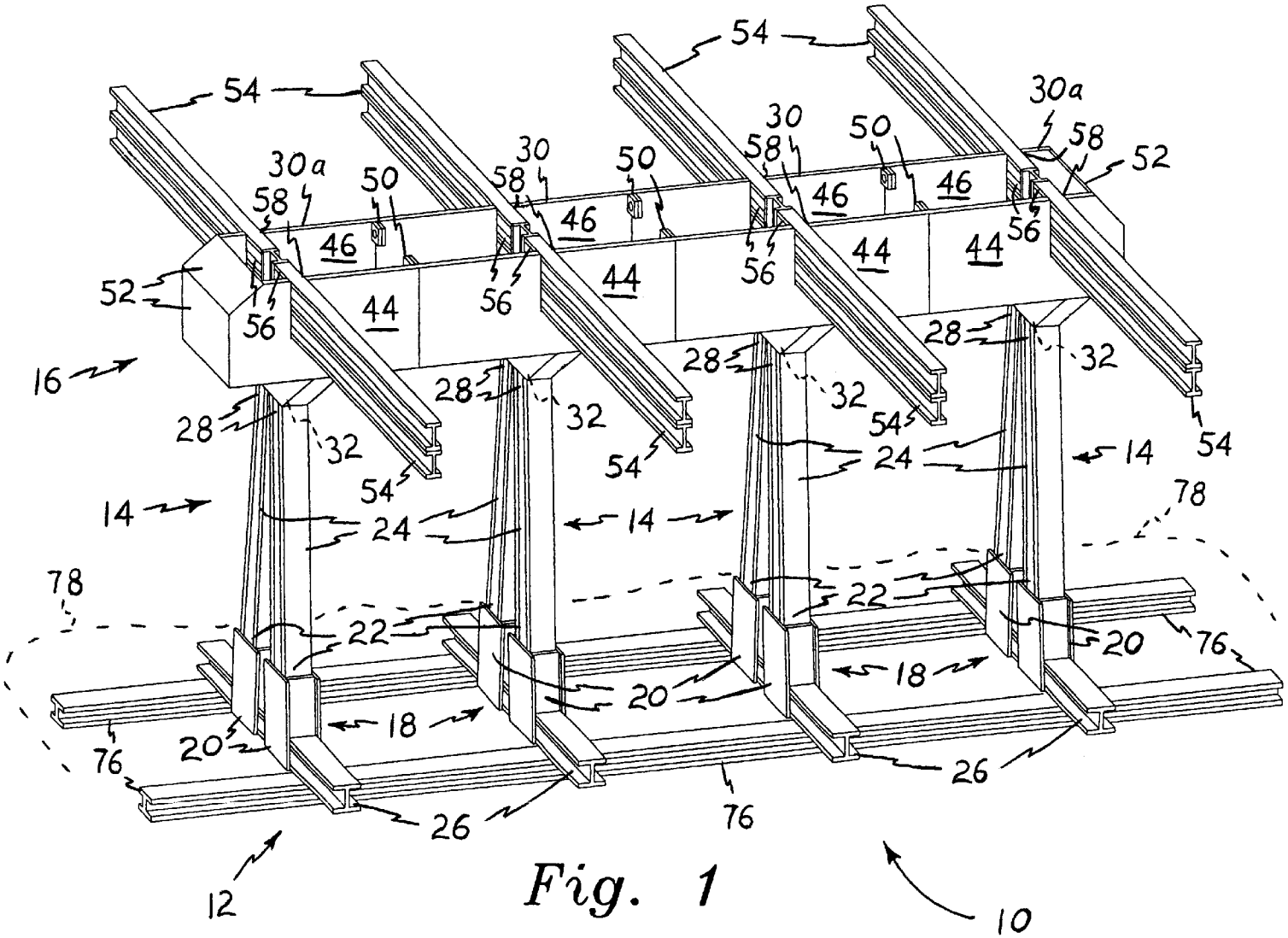
FIG. 1 is a top and side perspective view of the present prefabricated pier system invention, showing its general configuration and features.

FIG. 1 illustrates an exemplary pier construction using the prefabricated components of the present invention. The pier 10 basically comprises a foundation assembly 12, a series of column pairs 14, and a pier cap assembly 16. These various components are for the most part built up from premanufactured HP (H section pier) and/or other flanged, I beam configuration steel stock, with the primary exception of the components forming the walls and floors of the pier cap components, discussed further below. While the pier assembly 10 of FIG. 1 illustrates a series of four column pairs 14, it will be seen that any practicable number of such column pairs may be used to construct a pier 10 according to the present invention, depending upon the span between column pairs and the total width of the span being constructed.

The foundation assembly 12 comprises a series of prefabricated pier base assemblies 18, with each including a pair of spaced apart column base sleeves 20 each formed by welding up a series of four steel plates to form a rectangular structure. alternatively, the sleeves 20 may be formed by butt welding the flange edges of adjacent sections of HP or I beam stock, with the area between the two webs and the joined flanges defining a pier sleeve. The sleeves 20 are formed to fit closely about the base ends 22 of the respective steel columns 24 installed therein, with a minimal amount of play. The sleeves 20 are in turn permanently secured (e.g., welded) in pairs atop an elongate horizontal support beam 26, with the beam 26 being parallel to the span of the completed structure when the pier bases are installed during construction.

The pier base sleeves 20 are welded to the underlying support beam 26 with a relatively small gap or span therebetween, with the two base sleeves 20 of each support beam 26 being angled slightly toward one another so the columns 24 of their respective column pair 14 will meet at their respective upper ends 28. This angle between the two columns 24 of each column pair 14 is preferably about three degrees, and provides good stability for each of the pier column assemblies when construction is complete. It will be seen that other converging or diverging angles may be used between each of the columns 24 of each column pair 14, as desired, or the sleeves 20 and their respective columns 24 may be installed parallel to one another, if so desired, without departing from the essence of the present invention. These pier base assemblies, comprising pairs of column base sleeves 20 and their underlying support beam 26, are prefabricated at a manufacturing site remote from the construction site for the pier supported structure, and shipped to the construction site after fabrication.

A series of prefabricated intermediate and end steel pier cap sections, respectively 30 and 30*a*, corresponding in number to the number of pier base members 18 and column pairs 14, is provided for assembly at the construction site and for installation atop the columns 24. These pier cap sections 30 and 30*a* in turn support the spanwise girders of the pier supported structure, generally as shown in FIG. 1 of the drawings.

FIGS. 2 through 5 provide more detailed views of an individual intermediate pier cap section 30. Each pier cap section 30 and 30*a* includes a depending column end pocket 32 thereunder (shown in FIGS. 3 through 5), for capturing the two upper ends 28 of a corresponding column pair 14 therein. Each column end pocket 32 is relatively wide, in order to accept the two adjacent column upper ends 28 in a single receptacle. Alternatively, plural pockets could be provided to hold individual column upper ends, if so desired, but the triangulation provided by spacing the column lower ends 22 apart from one another in each column pair 14, and joining their upper ends 28 together, provides greater stability than would be provided by parallel column pairs or by a single column at each pier base assembly and pier cap section.

Each column end pocket 32 is formed of a series of lateral and spanwise (i. e., parallel to the girder orientation) walls, respectively 34 and 36, which define a receptacle therein for securing the upper ends 28 of a column pair 14 therein. The pockets 32 are braced externally by a series of brace plates, respectively 38 and 40, for further strength. As the interior lateral walls 34 are angled to match the converging angle of the two columns 24 of the column pairs 14, the upper ends 28 of each column pair 14 wedge tightly into their respective pocket structures 32 to provide a secure assembly. Additional rigidity is provided by additional wedge plates 42 driven between the outer flange of each column member 14 and the adjacent interior lateral wall 34, and welded to provide a solid, permanent assembly.

Each pier cap section includes opposite first and second steel plate walls (e. g., ¼ inch plate), respectively 44 and 46, and a steel plate floor 48 extending between and joining the two walls 44 and 46. Each pier cap section further includes some means of joining a series of sections together end to end, e. g., inwardly disposed flanges 50 with conventional fastener holes for bolting the sections together, etc. Alternatively, the sections could be welded together, if so desired. In addition, the pier cap end sections 30*a* each include an end wall 52. When a series of intermediate pier cap sections 30 are assembled with first and second end sections 30*a*, the result is a pier cap box assembly or structure 16 having a continuous closed floor, continuous closed side walls, closed end walls, and an open top, with the interior volumes of each section 30 and 30*a* communicating with one another. This assembly 16 is then installed atop the column pairs 14 to serve as a permanently installed concrete form for forming a concrete pier cap enclosed by the steel pier cap assembly 16.

Figure 4:
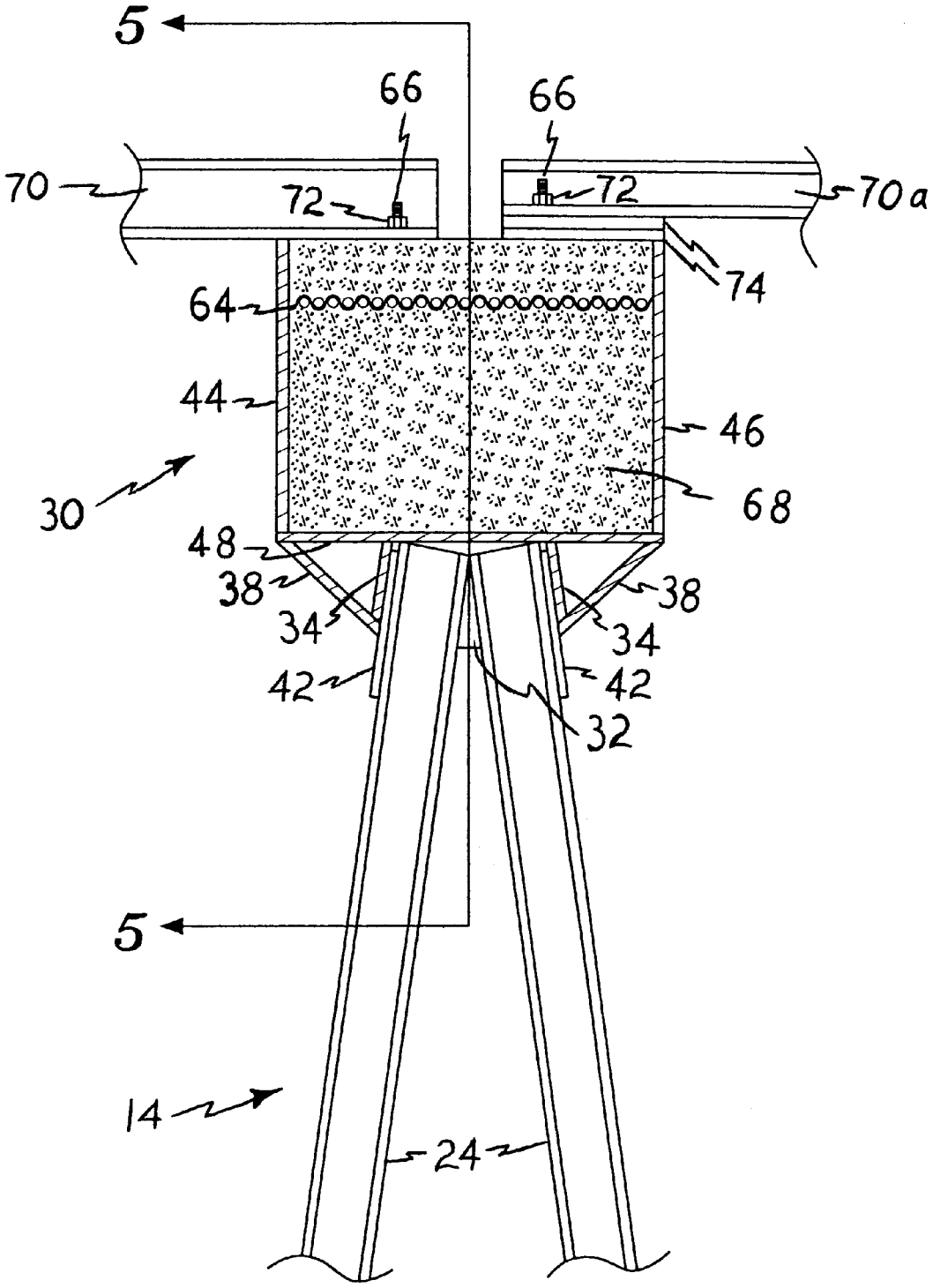
FIG. 4 is an elevation view in section of a pier cap of the present invention, showing an alternative single girder attachment.
Figure 5:
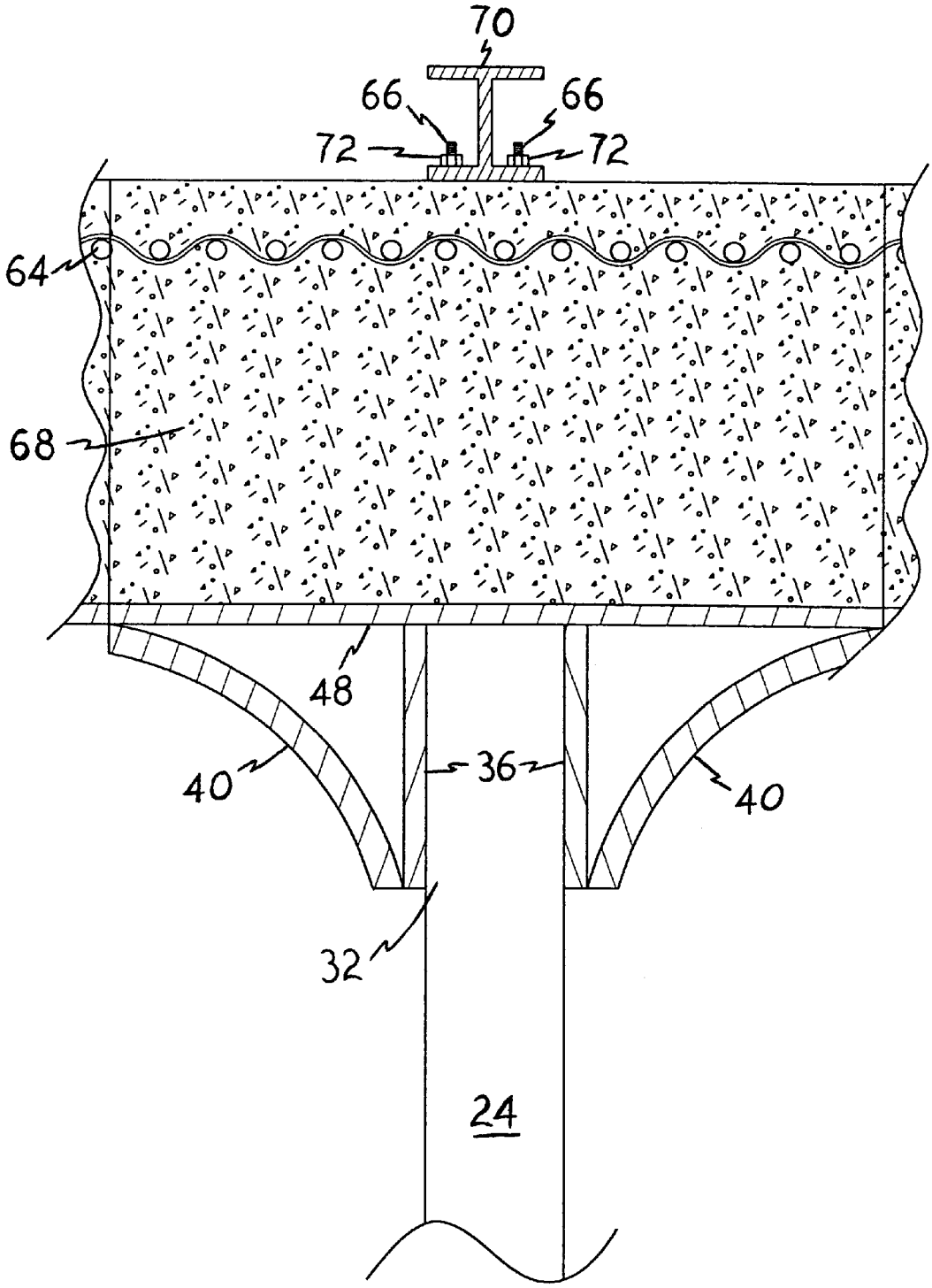
FIG. 5 is an elevation view in section along line 5—5 of FIG. 4, showing further details of the pier cap with single girder attachment.

The present prefabricated pier system is adapted for use with conventional girder construction, as illustrated in FIGS. 4 and 5, but may also be readily adapted for use with the prefabricated girder system disclosed in U.S. Pat. No. 5,966,764 issued on Oct. 19, 1999 to the present inventor, titled "Roll Beam Girder System For Bridges," and incorporated herein by reference. In that system, relatively shorter lengths of girders are prefabricated at a site remote from the construction site, and are assembled at the construction site for installation.

Figure 2:
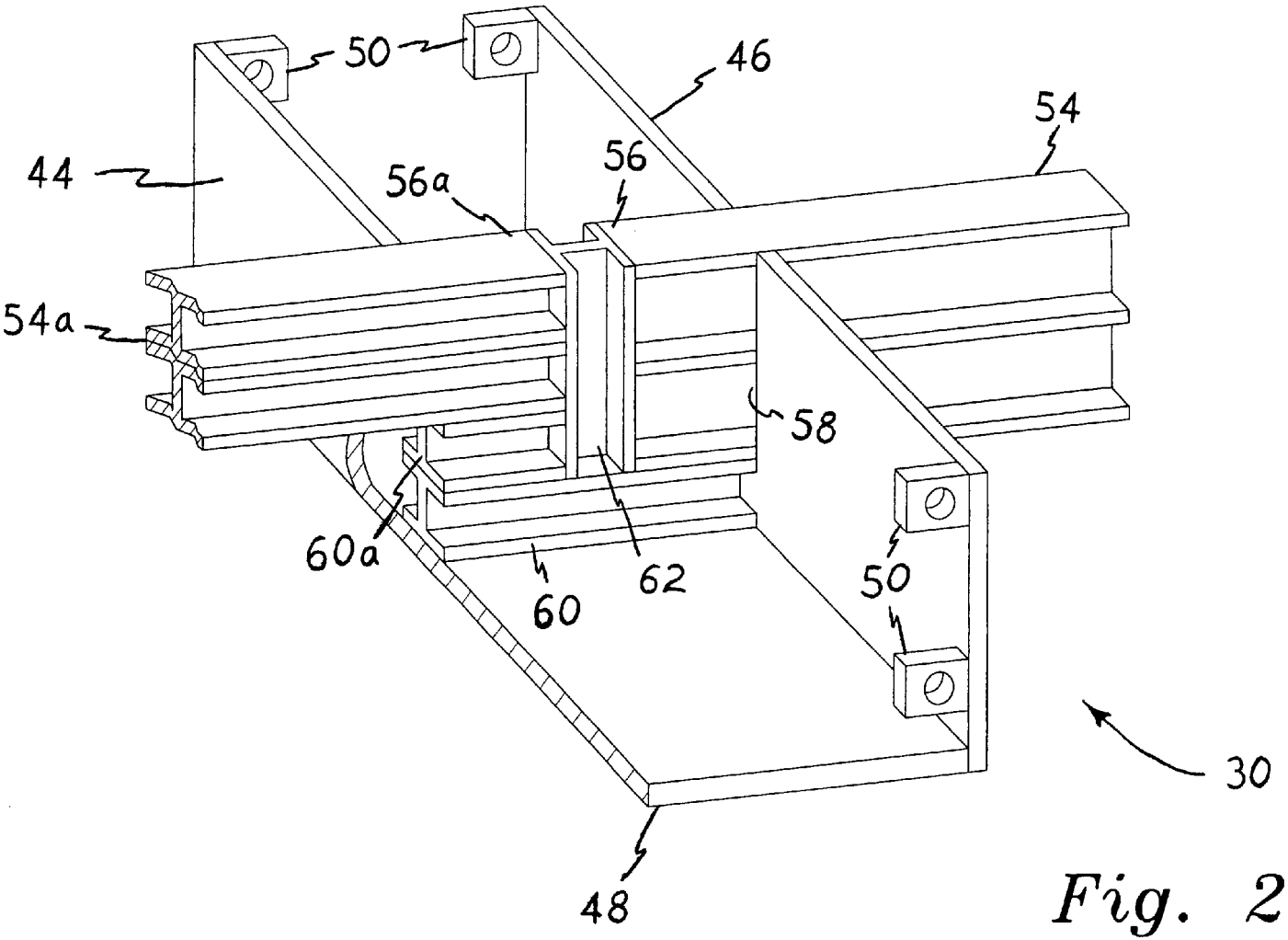
FIG. 2 is a detailed perspective view in partial section of a single pier cap section of the present pier system invention, showing details of the installation of the opposed ends of built up girders therein.
Figure 3:
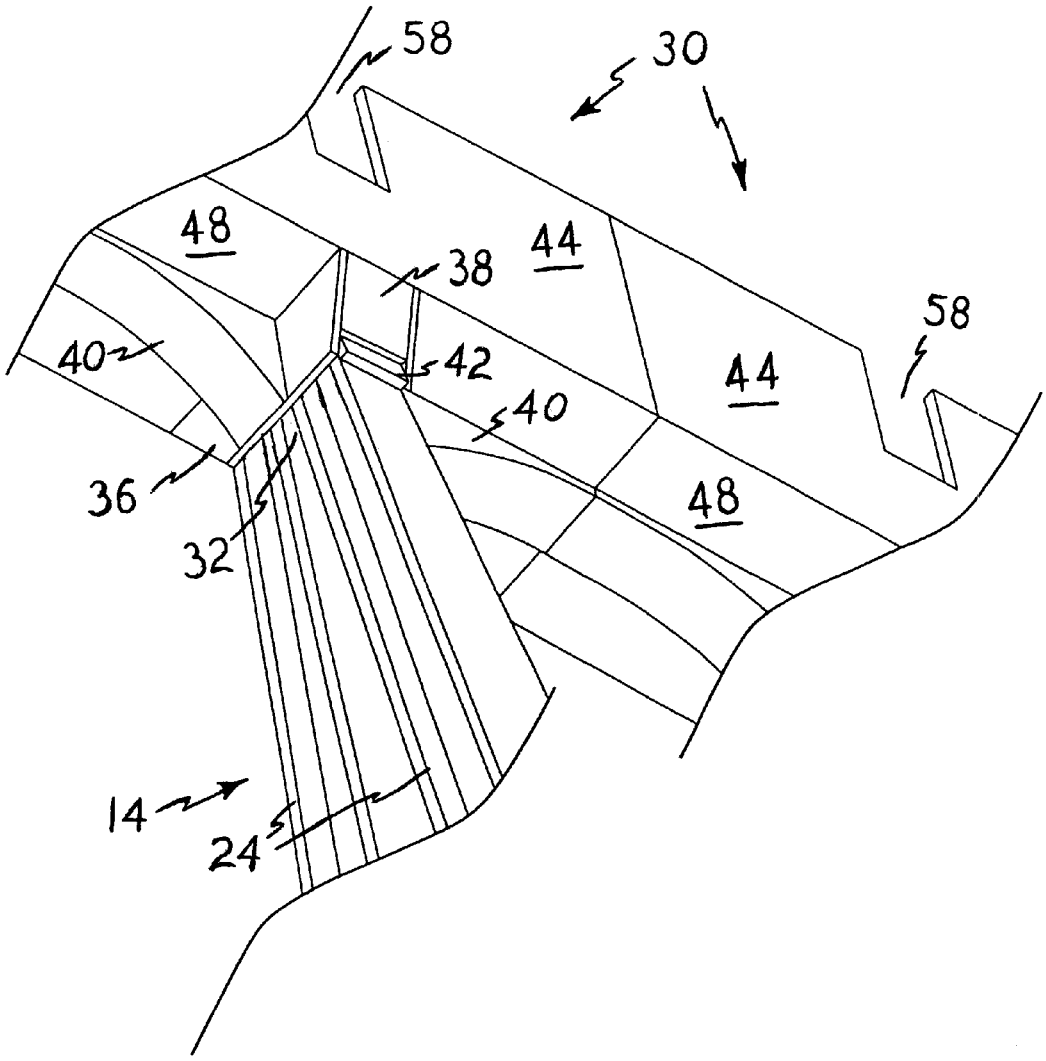
FIG. 3 is a bottom perspective view of a pier cap, showing details of the column end pocket provided beneath each of the pier cap sections.

The assembled girders of the '764 U.S. Patent system each have a slight arch configuration, which results in a horizontal compressive force being applied to each end thereof due to the weight of the structure and any load thereon. These girders are assembled from doubled individual girders which are stacked atop one another and bolted together, with a "keystone" fit being provided at the ends of the sections between supporting piers or anchor points. Such double height girders 54 are illustrated in FIGS. 1 and 2 of the drawings. The ends 56 of the built-up girders 54 of the '764 U.S. Patent system are installed in girder retaining slots 58 formed in the side walls 44 and 46 of each of the pier cap sections 30 and 30a, and supported therein by a support structure detailed in FIG. 2 of the drawings.

The support structure essentially comprises at least one horizontal support member 60 (short HP beam, etc.), which is placed transversely across the floor 48 of the pier cap section 30 (or 30*a*), beneath and parallel to the girder span. In the example of FIG. 2, a first double girder end 56 of the relatively heavy girder assembly 54 is resting atop the single support member 60, with the smaller double girder end 56*a* formed of smaller girders 54*a* (as would be suitable for a shorter span or to carry lighter loads) resting atop an additional support member 60*a*. As noted above, this system produces some horizontal thrust loads, and accordingly, a compression member 62 (HP beam length, etc.) is placed between girder ends 56, 56*a* to act as a compression bearing area, rather than abutting the beam ends directly against one another.

The girder installation and support system illustrated in FIGS. 1 and 2 has the advantage of positioning the upper surfaces of the girder ends 56, 56*a* in the same plane, regardless of the depth of the girders 54 or 54*a* installed. The horizontal girder support members 60 and 60*a* may be built up from any number or dimensions of girders (or other suitable structure) to any depth required in order to provide the coplanar installation of the girder upper surfaces, as shown in FIGS. 1 and 2. The support structure 60 (and 60*a*, as required) and compression member 62 are permanently secured within the pier section 30 (or 30*a*), preferably by welding in place at the time of their fabrication at the manufacturing site, with the girder ends 56 (and 56*a*) preferably being permanently bolted to the underlying support member(s) 60 (60*a*) at the construction site.

As noted further above, the present prefabricated pier system may also be used in combination with conventional unitary girders resting thereatop. Such a configuration is illustrated in FIGS. 4 and 5 of the drawings. The box-like structure of the pier cap section 30 of FIGS. 4 and 5 is essentially the same as that of the pier cap sections 30 (and 30*a*) illustrated in FIGS. 1 through 3. The only differences between the pier cap section 30 of FIGS. 4 and 5 and that of other drawing Figures, is that no internal girder support structure and no girder retaining slots are provided in the pier cap section 30 of FIGS. 4 and 5. Rather, reinforcing screen 64 or the like and threaded anchor rods 66 are installed, and the pier cap assembly is filled with concrete 68.

Once the concrete 68 has cured, the conventional girders 70 (and 70*a*) are installed atop the pier cap sections 30 (and 30*a*), and locked into place by means of nuts 72 secured to the threaded anchor rods 66. Provision may be made for girders having different depths, by means of one or more shims 74 placed between the top of the concrete fill 68 and rim of the pier cap section 30, and the overlying smaller girder 70*a*. As these conventional girders 70 and 70*a* have no arch, they do not produce any lateral compressive force when loaded. Hence, the compression member 62 provided for the built up girder assemblies 54, 54*a* and illustrated in FIG. 2 of the drawings, is not required with the present prefabricated system when used with conventional girders 70, 70*a*, etc.

The present prefabricated pier system 10 provides much greater efficiencies in a method of construction of bridges, overpasses, and other pier supported construction. The vast majority of the structure of the present system is prefabricated at a manufacturing plant remote from the construction or installation site of the pier, and shipped in relatively easily transportable units to the actual construction site. This is even more true when the built up girder system of U.S. Pat. No. 5,966,764, issued to the present inventor and cited above, is used in combination with the present prefabricated pier system invention.

The present pier construction method begins with the digging of a conventional pier footing hole at the construction site, to ready the site for installation of the prefabricated pier of the present invention. Simultaneously with the digging of the pier footing, or at least close to that time, the prefabricated components comprising the pier base assemblies 18, support column pairs 14, and pier cap sections 16 are transported to the construction site, along with the required horizontal span girders 54, 54*a*, and/or 70, 70*a* and a pair of leveling beams 76 (HP or I beam members, shown in FIG. 1) for each pier to be constructed.

When at least the pier base assemblies 18 and leveling beams 76 have arrived at the construction site and the footing hole has been formed, the leveling beams 76 are placed and leveled within the footing hole and the pier base assemblies 18 are permanently secured (preferably welded) thereacross, generally as shown in FIG. 1 of the drawings. A concrete foundation 78 (shown in broken lines in FIG. 1) is then poured into the footing hole, securing the pier base structure comprising the plurality of pier base assemblies 18 and leveling beams 76 within the foundation hole. The concrete 78 is leveled to the upper edges of the pier base sleeves 20, or at least close to the level of the upper edges of the pier sleeves, with the sleeves 20 remaining open to accept the pier columns 24.

Once the foundation concrete 78 has cured, the base ends of the steel columns 24 are set into their respective foundation sleeves 20 and permanently secured (preferably welded) therein. The series of pier cap sections 30 and 30*a* are assembled together, by bolting them together at their mutually adjacent attachment lugs 50, or alternatively by welding, as desired, to form the completed pier cap assembly 16. The pier cap assembly 16 is then installed atop the upper ends 28 of the column pairs 14, and permanently secured (welded, etc.) in place to complete the basic pier structure 10.

The pier cap sections 30 and 30*a* were previously prefabricated at the manufacturing site for the various components, as described further above. The fabrication of these pier cap sections 30 and 30*a* includes the forming of any required girder retaining slots 58 and installation of any girder support and compression members 60, 60*a*, and 62, as illustrated in FIG. 2 for the support of built up girders 54 and 54*a*, as the dimensions of the horizontal span girders will be known at the time of construction of the pier cap sections 30. Alternatively, the pier cap sections 30 and 30*a* may remain devoid of any internal girder support structure and retaining slots where their support of a conventional unitary girder structure is required, as illustrated in FIGS. 4 and 5 of the drawings. Anchor rods 66 may be installed within the pier cap sections 30 and 30*a* where the securing of conventional girders atop the pier cap sections is required.

At this point, any built up girders 54, 54*a* are installed with their respective ends 58, 58*a* resting atop their respective support structures 60 and 60*a* of the pier cap assembly 16. Reinforcement screen or the like is placed within the pier cap assembly 16, and concrete is poured into the pier cap assembly. Where conventional unitary girders 70 and/or 70*a* are to be used, the concrete 68 is poured into the pier cap assembly 16 before installation of the girders 70, 70*a* and any shim means 74 thereatop. At this point, the pier structure 10 is complete and other work (installing support structure for a road surface across the girders, etc.) may be accomplished.

In conclusion, the above described prefabricated pier system thus greatly reduces the amount of time required for the construction of such pier supported projects, by greatly reducing the amount of time required at the construction site for the fabrication of specifically formed components (concrete forms for the pouring of concrete pier caps, etc.). Moreover, as the pier cap forms remain permanently in place after pouring the concrete therein, no additional time is required for the concrete to cure or for the removal of these forms after the concrete has cured. The pier caps of the present prefabricated system provide all of the structural strength required, with the concrete providing only additional weight and mass to better secure the underlying structure. The three means of securing the pier caps of the present structure—welding, tightly wedging the upper ends of the columns into their respective pier cap end pockets, and the mass of the concrete contained within the pier cap assembly—provide an extremely solid, yet quickly and easily constructed, pier structure for the support of bridges, overpasses, and other pier supported structures as required.

It is to be understood that the present invention is not limited to the embodiments described above, but encompasses any and all embodiments within the scope of the following claims.

I claim:

1. A prefabricated pier system, comprising:

a plurality of pairs of steel columns, each column having a base end and an upper end opposite said base end;

a plurality of steel pier cap sections, each section having a single column end pocket depending therefrom, for permanently installing about the upper end of the columns of a corresponding one of said plurality of pairs of steel columns;

each of said pier cap sections further including at least a first wall, a second wall opposite said first wall, and a floor connecting said first wall and said second wall;

each of said pier cap sections further including means for connecting end to end with one another for forming a pier cap assembly, each pier cap assembly defining a form for receiving concrete;

a plurality of steel pier base assemblies, for supporting the base end of said plurality of pairs of steel columns;

a girder retaining slot disposed in said first wall and said second wall of each of said pier cap sections;

girder end support means disposed within each of said pier cap sections, between each said girder retaining slot thereof; and a compression member disposed between each said girder retaining slot of each of said pier cap sections.

2. The prefabricated pier system according to claim 1, wherein:

each of said pier base assemblies comprises a pair of spaced apart column base sleeves permanently secured atop an elongate horizontal support beam; and each of said column base sleeves being configured to fit closely about said base end of one of said steel columns.

3. The prefabricated pier system according to claim 1, further including wedge means disposed within each said column end pocket of each of said pier cap sections, for tightly wedging each said upper end of a corresponding one of said plurality of pairs of steel columns tightly together therein.

4. The prefabricated pier system according to claim 1 further including a first and a second end pier cap section each having an end wall, with each of said pier cap sections and each said end pier cap section forming a pier cap structure comprising a permanent concrete form when assembled together.

5. The prefabricated pier system according to claim 1, further including:

a girder retaining slot disposed in said first wall and said second wall of each of said pier cap sections; and girder end support means disposed within each of said pier cap sections, between each said girder retaining slot thereof.

6. The prefabricated pier system according to claim 1, further including anchor means for girder attachment thereatop.

7. A prefabricated pier system, comprising:

a plurality of pairs of steel columns, each column having a base end and an upper end opposite said base end;

a plurality of steel pier base assemblies;

each of said pier base assemblies comprising:

an elongate support beam; and a pair of spaced apart column base sleeves permanently secured atop said support beam, each of said column base sleeves being configured to fit closely about the base end of one of said steel columns;

a plurality of steel pier caps for permanently installing atop the upper ends of said plurality of pairs of steel columns, each of said plurality of steel pier caps including a single column end pocket depending therefrom, for permanently installing about said each said upper end of a corresponding one of said plurality of pairs of steel columns;

each of said pier cap sections further including at least a first wall, a second wall opposite said first wall, and a floor connecting said first wall and said second wall;

each of said pier cap sections further including means for connecting end to end with one another for forming a pier cap assembly;

a girder retaining slot disposed in said first wall and said second wall of each of said pier cap sections; and girder end support means disposed within each of said pier cap sections, between each said girder retaining slot thereof; and a compression member disposed between each said girder retaining slot of each of said pier cap sections.

8. The prefabricated pier system according to claim 7 further including a first and a second end pier cap section each having an end wall, with each of said pier cap sections and each said end pier cap section forming a pier cap structure comprising a permanent concrete form when assembled together.

9. The prefabricated pier system according to claim 7, further including anchor means for girder attachment atop each of said pier cap sections.

10. The prefabricated pier system according to claim 7, further including wedge means disposed within each said column end pocket of each of said pier cap sections, for tightly wedging each said upper end of a corresponding one of said plurality of pairs of steel columns tightly together therein.

* * * * *